United States Patent [19]

Hanada et al.

[11] Patent Number: 4,975,958

[45] Date of Patent: Dec. 4, 1990

[54] CODED SPEECH COMMUNICATION SYSTEM HAVING CODE BOOKS FOR SYNTHESIZING SMALL-AMPLITUDE COMPONENTS

[75] Inventors: Eisuke Hanada; Kazunori Ozawa, both of Tokyo, Japan

[73] Assignee: NEC Corporation, Tokyo, Japan

[21] Appl. No.: 354,662

[22] Filed: May 22, 1989

[30] Foreign Application Priority Data

May 20, 1988 [JP] Japan ..... 63-123148
May 23, 1988 [JP] Japan ..... 63-123840
Sep. 28, 1988 [JP] Japan ..... 63-245077

[51] Int. Cl.[5] ..... G10L 5/00

[52] U.S. Cl. ..... 381/36; 381/38; 381/35

[58] Field of Search ..... 381/35, 36, 38

[56] References Cited

U.S. PATENT DOCUMENTS 4,860,355 8/1989 Cappari ..... 381/36
4,910,781 3/1990 Ketchum ..... 381/36

*Primary Examiner*—Emanuel S. Kemeny

*Attorney, Agent, or Firm*—Sughrue, Mion, Zinn, Macpeak & Seas

[57] ABSTRACT

In coded speech communication, discrete speech samples are analyzed to generate a first signal indicating the fine pitch structure of the speech samples and a second signal indicating their spectral characteristic. The amplitudes and locations of main excitation pulses are determined from the fine pitch structure and spectral characteristic and a third signal indicating the determined pulse amplitudes and locations is generated. The difference between the speech samples and the main excitation pulses is detected and used in auxiliary excitation pulse calculation to determine gain and index values of auxiliary excitation pulses by retrieving stored auxiliary excitation pulses from a code book so that the retrieved auxiliary excitation pulses approximate the difference. The first, second and third coded signals and the gain and index values are transmitted through a communication channel to a distant end where a replica of the main excitation pulses is recovered from the received first and third signals and a replica of the auxiliary excitation pulses is recovered from a code book in response to the received fourth signal. These replicas are modified with the second signal to recover a replica of the original speech samples.

23 Claims, 13 Drawing Sheets

119B
FROM SUB 118
e(n)
200
SUB-FRAMING CIRCUIT
201
WGHTNG FILTER
202
CROSS-CORRE-LATION
203
OPTIMUM GAIN CALCUL-ATION
GAIN
TO MUX 120
INDEX
FROM DQ 108
205
SPCTRL ENVLP FILTER
206
WGHTNG FILTER
207
AUTO-CORRE-LATION
720A
CODE BOOK (FRICATIVE)
720B
CODE BOOK (EXPLOSIVE)
720C
CODE BOOK (OTHERS)
710
SELECTOR
FROM ANALYZER 700

CODED SPEECH COMMUNICATION SYSTEM HAVING CODE BOOKS FOR SYNTHESIZING SMALL-AMPLITUDE COMPONENTS

BACKGROUND OF THE INVENTION

The present invention relates generally to speech coding techniques and more specifically to a coded speech communication system.

Araseki, Ozawa, Ono and Ochiai, "Multi-Pulse Excited Speech Coder Based on Maximum Cross-correlation Search Algorithm" (GLOBECOM 83, IEEE Global Telecommunication, 23.3, 1983) describes transmission of coded speech signals at rates lower than 16 kb/s using a coded signal that represents the amplitudes and locations of main, or large-amplitude excitation pulses to be used as a speech source at the receive end for recovery of discrete speech samples as well as a coded filter coefficient that represents the vocal tract of the speech. The amplitudes and locations of the large-amplitude excitation pulses are derived by circuitry which is essentially formed by a subtractor and a feedback circuit which is connected between the output of the subtractor and one input thereof. The feedback circuit includes a weighting filter connected to the output of the subtractor, a calculation circuit, an excitation pulse generator and a synthesis filter. A series of discrete speech samples is applied to the other input of the substractor to detect the difference between it and the output of synthesis filter. The calculation circuit determines the amplitude and location of a pulse to be generated in the excitation circuit and repeats this process to generate subsequent pulses until the energy of the difference at the output of the subtractor is reduced to a minimum. However, the quality of recovered speech of this approach is found to deteriorate significantly as the bit rate is reduced below some point. A similar problem occurs when the input speech is a high pitch voice, such as female voice, because it requires a much greater number of excitation pulses to synthesize the quality of the input speech in a given period of time (or frame) than is required for synthesizing the quality of low-pitch speech signals during that period. Therefore, difficulty has been encountered to reduce the number of excitation pulses for low-bit transmission without sacrificing the quality of recovered speech.

Japanese Laid-Open Patent Publication Sho No. 60-51900 published Mar. 23, 1985 describes a speech encoder in which the auto-correlation of spectral components of input speech samples and the cross-correlation between the input speech samples and the spectral components are determined to synthesize large-amplitude excitation pulses. The fine pitch structure of the input speech samples is also determined to synthesize the auxiliary, or small-amplitude components of the original speech. However, the correlation between small-amplitude components is too low to precisely synthesize such components. In addition, transmission begins with an excitation pulse having a larger amplitude and ends with a pulse having a smaller amplitude that is counted a predetermined number from the first. If a certain upper limit is reached before transmitting the last pulse, the number of small-amplitude excitation pulses that have been transmitted is not sufficient to approximate the original speech. Such a situation is likely to occur often in applications in which the bit is low.

SUMMARY OF THE INVENTION

It is therefore an object of the present invention to provide speech coding which permits low-bit transmission of a speech signal over a wide range of frequency components.

Another object of the present invention is provide speech coding which enables low-transmission of the coded speech with a minimum amount of computations.

According to a first aspect of the present invention, a speech encoder is provided which analyzes a series of discrete speech samples and generates a first coded signal representative of the fine structure of the pitch of the speech samples and generates a second coded signal representative of the spectral characteristic of the speech samples. The amplitudes and locations of large-amplitude excitation pulses are determined from the fine pitch structure and the spectral characteristic of the speech samples. The difference between the speech samples and the large-amplitude excitation pulses is detected. Gain and index values of small-amplitude excitation pulses are determined by retrieving stored small-amplitude excitation pulses from a code book so that the retrieved small-amplitude excitation pulses approximate the difference, wherein the gain value represents the amplitude of the small-amplitude excitation pulses and the index value represents locations of the stored excitation pulses in the code book. The first, second and third coded signals and the gain and index values are transmitted through a communication channel to a distant end for recovery of large- and small-amplitude excitation pulses.

In a specific aspect, the amplitudes and locations of large-amplitude excitation pulses are determined from the first and second coded signals as well as from the detected difference so that the large-amplitude excitation pulses approximate the difference.

By the use of the code book, small-amplitude excitation pulses can be more precisely recovered at the distant end of the channel than is performed by the prior techniques without substantially increasing the amount of information to be transmitted.

According to a second aspect, the present invention provides a coded speech communication system which comprises a pitch analyzer and LPC (linear predictive coding) analyzer for analyzing a series of discrete speech samples and respecxtively generating a first signal representative of the fine structure of the pitch of the speech samples and a second signal representative of the spectral characteristic of the speech samples. A calculation circuit determines the amplitudes and location of large-amplitude excitation pulses from the first and second signals and generates a third signal representative of the determined pulse amplitudes and locations. A small-amplitude excitation pulse calculator having a code book is provided to generate a fourth signal representative of small-amplitude excitation pulses. The first, second, third and fourth signals are multiplexed and transmitted through a communication channel. These signals are received at the opposite end of the channel. A replica of the large-amplitude excitation pulses is derived from the received first and third signals and a replica of the small-amplitude excitation pulses is derived from a code book in response to the received fourth signal. These replicas are modified with the second signal to recover a replica of the original speech samples.

BRIEF DESCRIPTION OF THE DRAWINGS

The present invention will be described in further detail with reference to the accompanying drawings, in which.

DETAILED DESCRIPTION

Figure 1A:
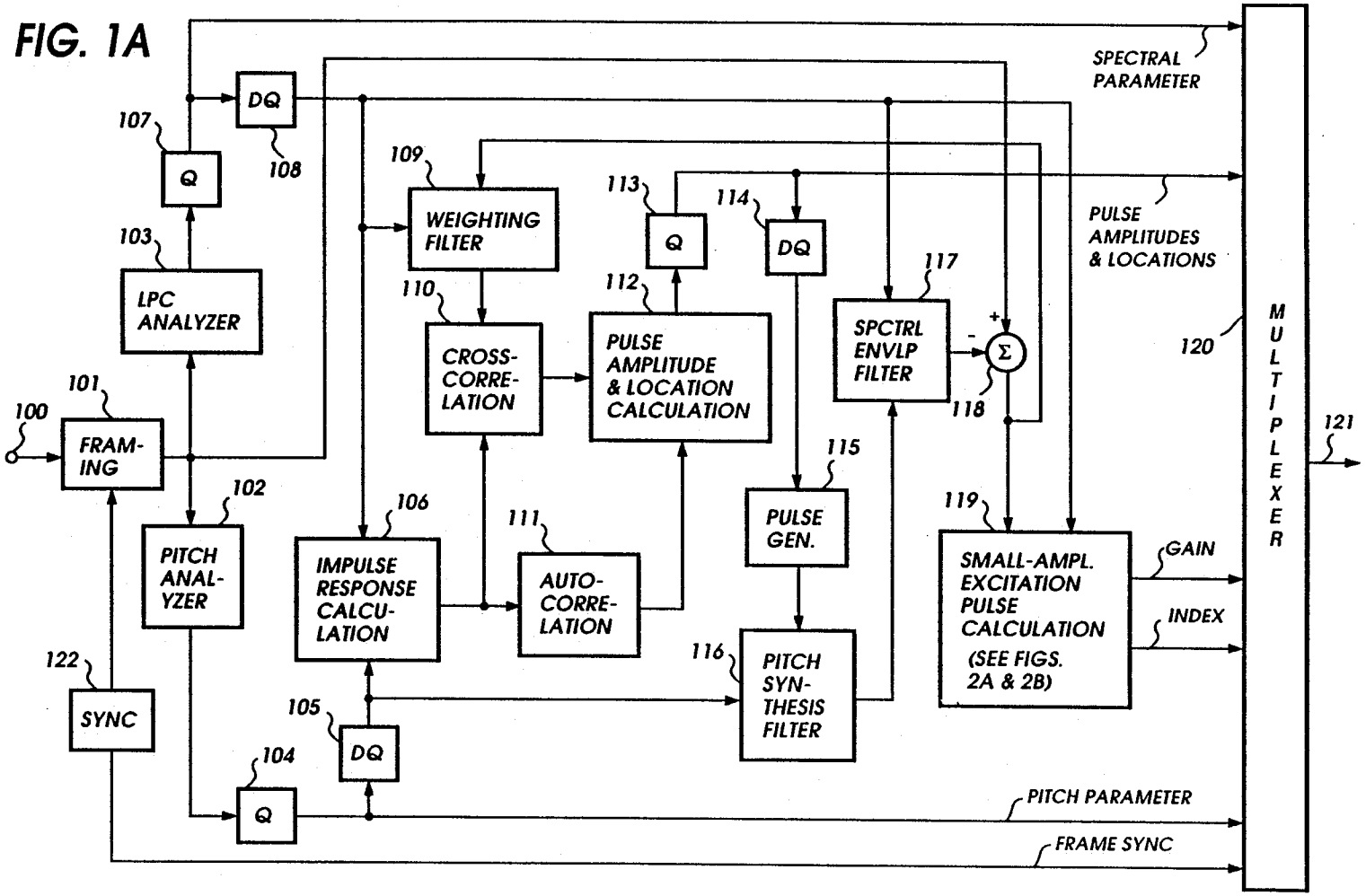
FIGS. 1A and 1B are block diagrams of a speech encoder and a speech decoder, respectively, according to an embodiment of the present invention.
Figure 1B:
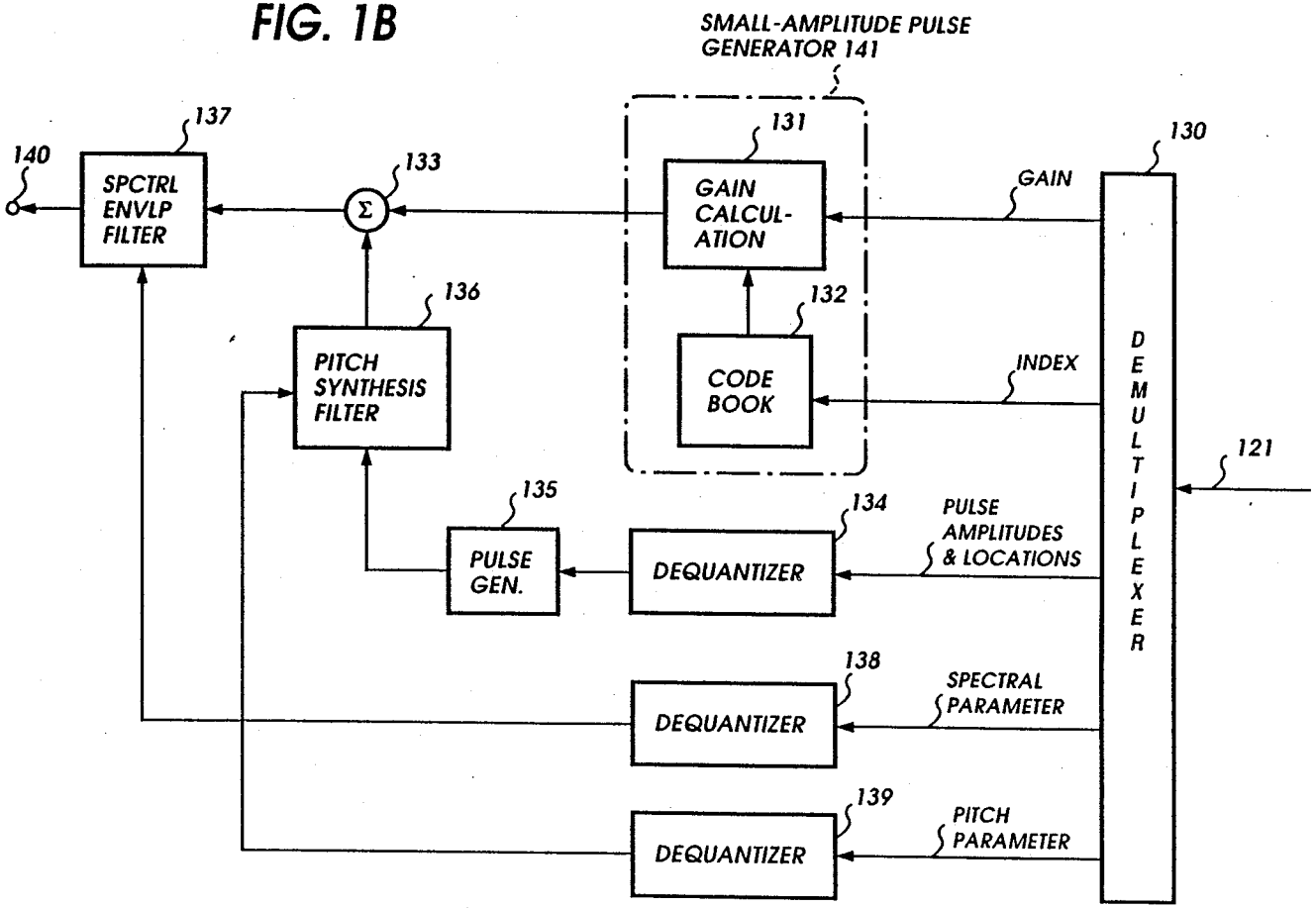

Referring now to FIGS. 1A and 1B, there is shown a coded speech communication system according to a first preferred embodiment of the present invention. The system comprises a speech encoder (FIG. 1A) and a speech decoder (FIG. 1B). The speech encoder comprises a buffer, or framing circuit 101 which divides digitized speech samples (with a sampling frequency of 8 kHz, for example) into frames of, typically, 20-millisecond intervals in response to frame pulses supplied from a frame sync generator 122. Frame sync generator 122 also supplies a frame sync code to a multiplexer 120 to establish the frame start timing for signals to be transmitted over a communication channel 121 to the speech decoder. A pitch analyzer 102 is connected to the output of the framing circuit 101 to analyze the fine structure (pitch and amplitude) of the framed speech samples to generate a signal indicative of the pitch parameter of the original speech in a manner as described in B.S. Atal and M.R. Shroeder, "Adaptive Predictive Coding of Speech Signals", Bell System Technical Journal, October 1970, pages 1973 to 1986. The output of the pitch analyzer 102 is quantized by a quantizer 104 for translating the quantization levels of the pitch parameter so that it conforms to the transmission rate of the channel 121 and supplied to the multiplexer 120 on the one hand for transmission to the speech decoder. The quantized pitch parameter is supplied, on the other hand, to a dequantizer 105 and thence to an impulse response calculation unit 106 and a pitch synthesis filter 116. The function of the dequantizer 105 is a process which is inverse to that of the quantizer 104 to generate a signal identical to that which will be obtained at the speech decoder by reflecting the same quantization errors associated with the quantizer 104 into the processes of impulse response calculation unit 106 and pitch synthesis filter 116 as those which will be reflected into the processes of the speech decoder.

The framed speech samples are also applied to a known LPC (linear predictive coding) analyzer 103 to analyze the spectral components of the speech samples in a known manner to generate a signal indicative of the spectral parameter of the original speech. The spectral parameter is quantized by a quantizer 107 and supplied on the one hand to the multiplexer 120, and supplied, on the other, through a dequantizer 108 to the impulse response calculation unit 106, a perceptual weighting filter 109, a spectral envelope filter 117 and to a small amplitude calculation unit 119. The functions of the quantizer 107 and dequantizer 108 are similar to those of the quantizer 104 and dequantizer 105 so that the quantization error associated with the quantizer 107 is reflected into the results of the various circuits that receive the dequantized spectral parameter in order to obtain signals identical to the corresponding signals which will be obtained at the speech decoder.

The impulse response calculation unit 106 calculates the impulse responses of the pitch synthesis filter 116 and spectral envelope filter 117 in a manner as described in Japanese Laid-Open Patent Publication No 60-51900. Perceptual weighting filter 109 provides variable weighting on a difference signal, which is detected by a subtractor 118 between a syntesized speech pulse from the output of spectral envelope filter 117 and the original speech from the framing circuit 101, in accordance with the dequantized spectral parameter from dequantizer 108 in a manner as described in the aforesaid Japanese Lain-Open Publication. Output signals from impulse response calculation unit 106 and perceptual weighting filter 109 are supplied to a cross-correlation detector 110 to determine the cross-correlation between the impulse responses of the filters 116 and 117 and the weighted speech difference signal from subtractor 118, the output of the cross-correlation detector 110 being coupled to a first input of a pulse amplitude and location calculation unit 112. The output of the impulse response calculator 106 is also applied to an auto-correlation detector 111 which determines the auto-correlation of the impulse response and supply its output to a second input of the pulse amplitude and location calculator 112.

Using the outputs of these correlation detector 110 and 111, the pulse amplitude and location calculator 112 calculates the amplitudes and locations of excitation pulses to be generated by a pulse generator 115. The output of pulse amplitude and location analyzer 112 is quantized by a quantizer 113 and supplied to multiplexer 117 on the one hand and supplied through a dequantizer 114 to the pulse generator 115 on the other. Excitation pulses of relatively large amplitudes are generated by pulse generator 115 and supplied to the pitch synthesis filter 116 where the excitation pulses are modified with the dequantized pitch parameter signal to synthesize the fine structure of the original speech. The functions of the quantizer 113 and dequantizer 114 are similar to those of the quantizer 104 and dequantizer 105 so that the quantization error associated with the quantizer 113 is reflected into the excitation pulses identical to the corresponding pulses which will be obtained at the speech decoder.

The output of pitch synthesis filter 116 is applied to the spectral envelope filter 117 where it is further modified with the spectral parameter to synthesize the spectral envelope of the original speech. The output of spectral envelope filter 117 is combined with the original speech samples from framing circuit 101 in the subtractor 118. The difference output of subtractor 118 represents an error between the synthesized speech pulses and the speech samples in each frame. This error signal is fed back to the weighting filter 109 as mentioned above so that it is modified with the spectral-parameter-controlled weighting function and supplied to the cross-correlation detector 110. The feedback operation proceeds so that the error between original speech and synthetic speech reduces to zero. As a result, there exist as many excitation pulses in each frame as there are necessary to approximate the original speech. The output of subtractor 118 is also supplied to the small amplitude calculation unit 119.

The quantized spectral parameter, pulse amplitudes and locations, pitch parameter, gain and index signals are multiplexed into a frame sequence by the multiplexer 120 and transmitted over the communication channel 12 to the speech decoder at the other end of the channel.

Figure 2A:
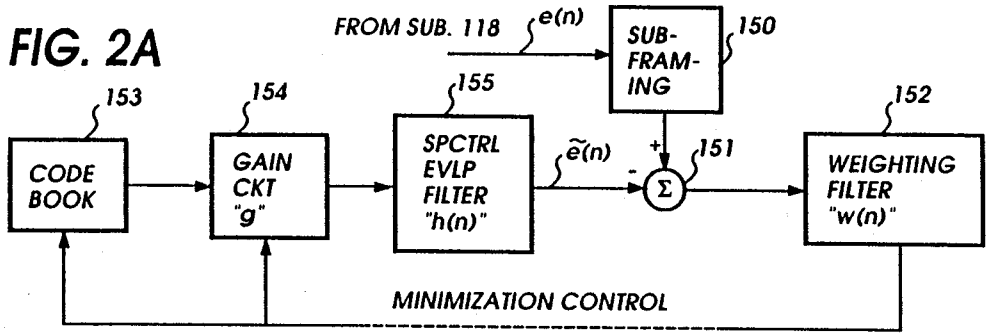
FIG. 2A is a schematic block diagram of the basic structure of the small amplitude calculation unit of FIG. 1A, and FIGS. 2B and 2C are block diagrams of different forms of the invention.

As shown in FIG. 2A, the small amplitude calculation unit 119 is basically a feedback-controlled loop which essentially comprises a subframing circuit 150, a subtractor 151, a perceptual weighting filter 152, a code book 153, a gain circuit 154 and a spectral envelope filter 155. Subframing circuit subdivides the frame interval of the difference signal from subtractor 118 into sub-frames of 5 milliseconds, each, for example. A difference between each sub-frame and the output of spectral envelope filter 155 is detected by subtractor 151 and supplied to weighting filter 152. The output of weighting filter 152 is used to calculate the gain "g" of gain circuit 154 and an index signal to be applied to the code book 153 so that they minimize the difference, or error output of subtractor 151. Code book 153 stores speech signals in coded form representing small-amplitude pulses of random phase. One of the stored codes is selected in response to the index signal and supplied to the gain control circuit 154 where the gain of the selected code is controlled by the gain control signal "g" and fed to the spectral envelope filter 155.

It is seen from FIG. 2A that the error output E of subtractor 151 is given by:

$$E = \sum_n [\{e(n) - g \cdot \tilde{e}(n)\} * w(n)]^2 \quad (1)$$

where, e(n) represents the input signal from subtractor 118, $\tilde{e}(n)$ representing the output of spectral envelope filter 206, w(n) representing the impulse response of the weighting filter 202 and the symbol * represents convolutional integration. The error E can be minimized when the following equation is obtained:

$$g = \frac{\Sigma e_w(n)\tilde{e}_w(n)}{\Sigma \tilde{e}_w(n)\tilde{e}_w(n)} \quad (2)$$

where, $$\tilde{e}_w(n) = \tilde{e}(n) * w(n) = n(n) * h(n) * w(n) \quad (3a)$$

$$e_w(n) = e(n) * w(n) \quad (3b)$$

and n(n) represents the code selected by code book 153 in response to a given index signal, and h(n) represents the impulse response of the spectral envelope filter 155. It is seen that the denominator of Equation 2 is an auto-correlation (or covariance) of $\tilde{e}_w(n)$ and the numerator of the equation is a cross-correlation between $\tilde{e}_w(n)$ and $e_w(n)$. Since Equation (1) can be rewritten as:

$$E = \sum_n e_w(n)^2 - g \sum_n e_w(n)\tilde{e}_w(n) \quad (4)$$

the code-book that minimizes the error E can be selected so that it maximizes the second term of Equation (4) and hence the gain "g".

Figure 2B:
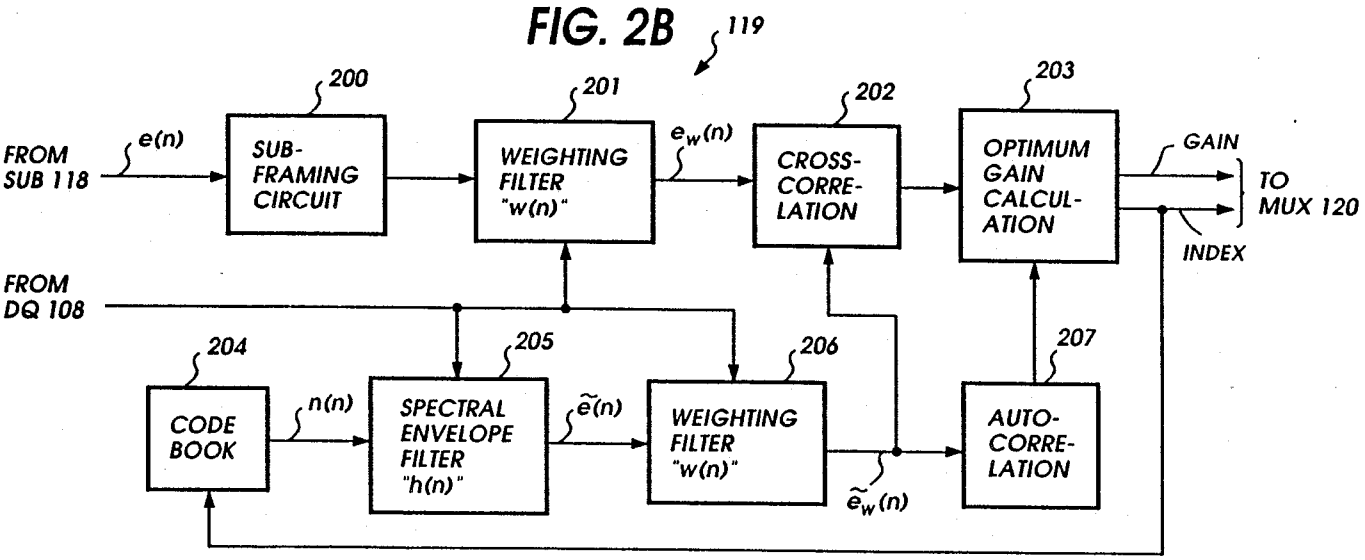

A specific embodiment of the small-amplitude excitation pulse calculation unit 119 is shown in FIG. 2B. Sub-frame signal e(n) from subframing circuit 200 is passed through perceptual weighing filter 201 having an impulse response w(n), so that it produces an output signal $e_w(n)$. A cross-correlation detector 202 receives output signals from weighting filters 201 and 206 to produce a signal representative of the cross-correlation between signals $\tilde{e}_w(n)$ and $e_w(n)$, or the numerator of Equation (4). The output of weighting filter 206 is further applied to an auto-correlation detector 207 to obtain a signal representative of the auto-correlation of signal $\tilde{e}_w(n)$, namely, the denominator of Equation (4). The output signals of both correlation detectors 202 and 207 are fed to an optimum gain calculation circuit 203 which arithmetically divides the signal from cross-correlation detector 202 by the signal from auto-correlation detector 207 to produce a signal representative of the gain "g" and proceeds to detect an index signal that corresponds to the gain "g". The index signal is supplied to code book 204 to select a corresponding code n(n) which is applied to spectral envelope filter 205 to produce a signal $\tilde{e}(n)$, which is applied to weighting filter 206 to generate the signal $\tilde{e}_w(n)$ for application to correlation detectors 202 and 207. In this way, a feedback operation proceeds and the optimum gain calculator 203 will produce multiple gain values and one of which is detected as a maximum value which minimizes the error value E for coupling to the multiplexer 120 and an index signal that corresponds to the maximum gain is selected for application to the code book 204 as well as to the multiplexer 120.

The amount of computations necessary to obtain $\tilde{e}_w(n)$ is substantial and hence the total amount of computations. However, the latter can be significantly reduced by the use of a cross-correlation function $\phi_{xh}$ which is given by:

$$\phi_{xh} = \Sigma e_w(n) h_w(n) \quad (5)$$

Since Equation (3*a*) can be rewritten as:

$$\tilde{e}_w(n) = n(n) * h_w(n) \quad (6)$$

substituting Equations (5) and (6) into Equation (2) results in the following equation:

$$g = \frac{\Sigma \phi_{xh} \cdot n(n)}{R_{hh}(0) \cdot R_{nn}(0)} \quad (7)$$

where, $R_{hh}(0)$ represents the energy of combined impulse response of the spectral envelope filter 155 and weighting filter 152 of FIG. 2A, or an auto-correlation of $h_w(n)$ and $R_{nn}(0)$ represents the energy, or an auto-correlation of a code signal n(n) which is selected by the code book 153 in response to a given index signal.

Figure 2C:
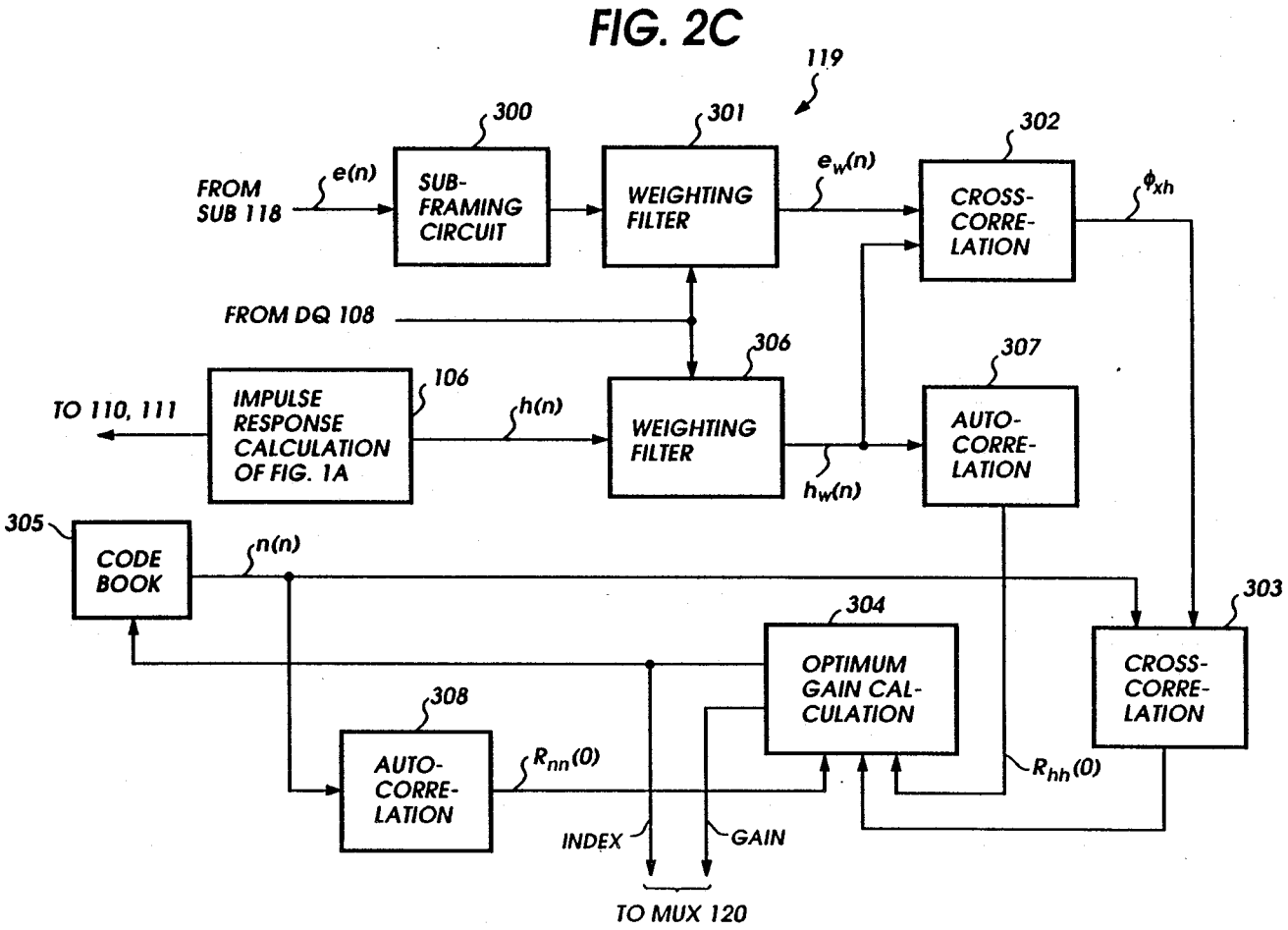

An embodiment shown in FIG. 2C is to implement Equation (7). The difference signal e(n) from subtractor 118 is sub-divided by sub-framing circuit 300 and weighted by weighting filter 301 to produce a signal $e_w(n)$. A weighting filter 306 is supplied with a signal representing the impulse response h(n) of the spectral envelope filter 155 which is available from the impulse response calculation unit 106 of FIG. 1A. The output of weighting filter 306 is a signal $h_w(n)$. The outputs of weighting filters 301 and 306 are supplied to a cross-correlation detector 302 to obtain a signal representing the cross-correlation $\phi_{xh}$, which is supplied to a cross-correlation detector 303 to which the output of code book 305 is also applied. Thus, the cross-correlation detector 303 produces a signal representative of the numerator of Equation (7) and supplies it to an optimum gain calculation unit 304.

An auto-correlation detector 307 is connected to the output of weighting filter 306 to supply a signal representing the auto-correlation $R_{hh}(0)$ (or energy of combined impulse response of the spectral envelope filter 155 and weighting filter 152) to the optimum gain calculation unit 304. The output of code 305 is further coupled to an auto-correlation detector 308 to produce a signal representing $R_{nn}(0)$ of code-book signal n(n) for coupling to the optimum gain calculation unit 304. The latter multiplies calculates $R_{hh}(0)$ and $R_{nn}(0)$ to derive the denominator of Equation (7) and derives the gain "g" of Equation (7) by arithmetically dividing the output of cross-correlation detector 303 by the denominator just obtained above and detects an index signal that corresponds to the gain "g". The index signal is supplied to the code book 305 to read a codebook signal n(n). Multiple gain values are derived in a manner similar to that describe above as the feedback operation proceeds and a maximum of the gain values which minimizes the error E is selected and supplied to the multiplexer 120 and a corresponding optimum value of index signal is derived for application to the multiplexer 120 as well as to the code book 305.

In FIG. 1B, the multiplexed frame sequence is separated into the individual component signals by a demultiplexer 130. The gain signal is supplied to a gain calculation unit 131 of a small-amplitude pulse generator 141 and the index signal is supplied to a code book 132 of decoder 141 identical to the code book of the speech encoder. According to the gain signal from the demultiplexer 130, gain calculation unit 131 determines the amplitudes of a code-book signal that is selected by code book 132 in response to the index signal from the demultiplexer 130 and supplies its output to an adder 133 as a small-amplitude pulse sequence. The quantized signals including pulse amplitudes and locations, spectral parameter and pitch parameter are respectively dequantized by dequantizers 134, 138 and 139. The dequantized pulse amplitudes and locations signal is applied to a pulse generator 135 to generate excitation pulses, which are supplied to a pitch synthesis filter 136 to which the dequantized pitch parameter is also supplied to modify the filter response characteristic in accordance with the fine pitch structure of the coded speech signal. It is seen that the output of pitch synthesis filter 136 corresponds to the signal obtained at the output of pitch synthesis filter 116 of the speech encoder. The output of pitch synthesis filter 136 is supplied as a large-amplitude pulse sequence to the adder 133 and summed with the small-amplitude pulse sequence from gain calculation circuit 131 and supplied to a spectral envelope filter 137 to which the dequantized spectral parameter is applied to modify the summed signal from adder 133 to recover a replica of the original speech at the output terminal 140.

Figure 3A:
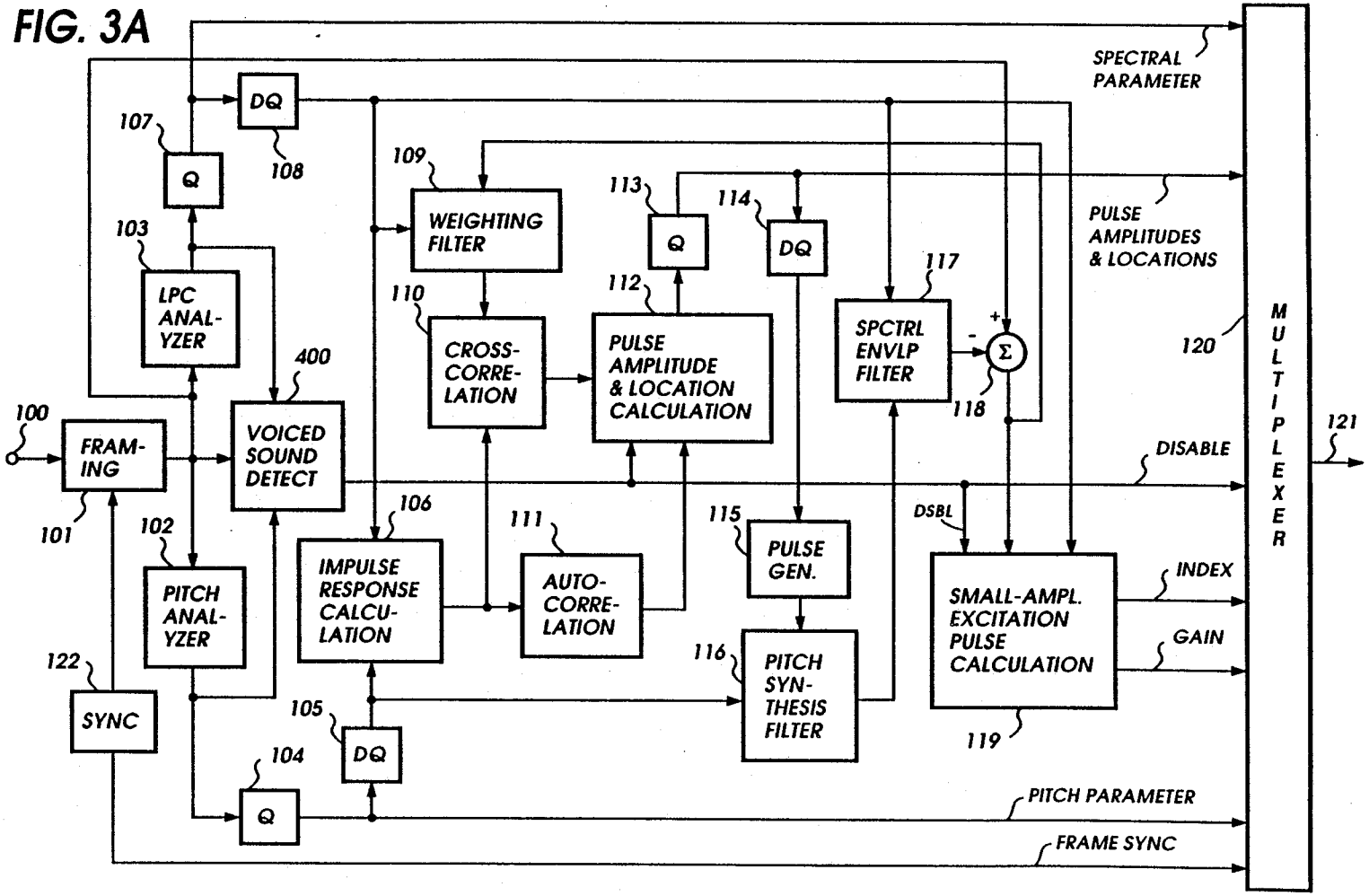
FIGS. 3A and 3B are block diagrams of the speech encoder and speech decoder, respectively, of a second embodiment of the present invention.

A modified embodiment of the present invention is shown in FIGS. 3A abd 3B. In FIG. 3A, the speech encoder of this modification is similar to the previous embodiment with the exception that it additionally includes a voiced sound detector 400 connected to the outputs of framing circuit 101, pitch analyzer 102 and LPC analyzer 103 to discriminate between voiced and unvoiced sounds and generates a logic-1 or logic-0 output in response to the detection of a voiced or an unvoiced sound, respectively. When a voiced sound is detected, a logic-1 output is supplied from voiced sound detector 400 as a disabling signal to the small-amplitude excitation pulse calculation unit 119 and multiplexed with other signals by the muliplexer 120 for transmission to the speech decoder. The small-amplitude calculation unit 119 is therefore disabled in response to the detection of a vowel, so that the index and gain signals are nullified and the disabling signal is transmitted to the speech decoder instead. Therefore, when vowels are being synthesized, the signal being transmitted to the speech decoder is composed exclusively of the quantized pulse amplitudes and locations signal, pitch and spectral parameter signals to permit the speech decoder to recover only large-amplitude pulses, and when consonants are being synthesized, the signal being transmitted is composed of the gain and index signals in addition to the quantized pulse amplitudes and locations signal and pitch and spectral parameter signals to permit the decoder to recover random-phase, small-amplitude pulses from the code book as well as large-amplitude pulses. The amount of information necessary to be transmitted to the speech decoder for the recovery of vowels can be reduced in this way. The elimination of the gain and index signals from the multiplexed signal is to improve the definition of unvoiced, or consonant components of the speech which will be recovered at the decoder. The disabling signal is also applied to the pulse amplitude and location calculation unit 112. In the absence of the disabling signal, the calculation circuit 112 calculates amplitudes and locations of a predetermined, greater number of excitation pulses, and in the presence of the disabling signal, it calculates the amplitudes and locations of a predetermined, smaller number of excitation pulses.

Figure 3B:
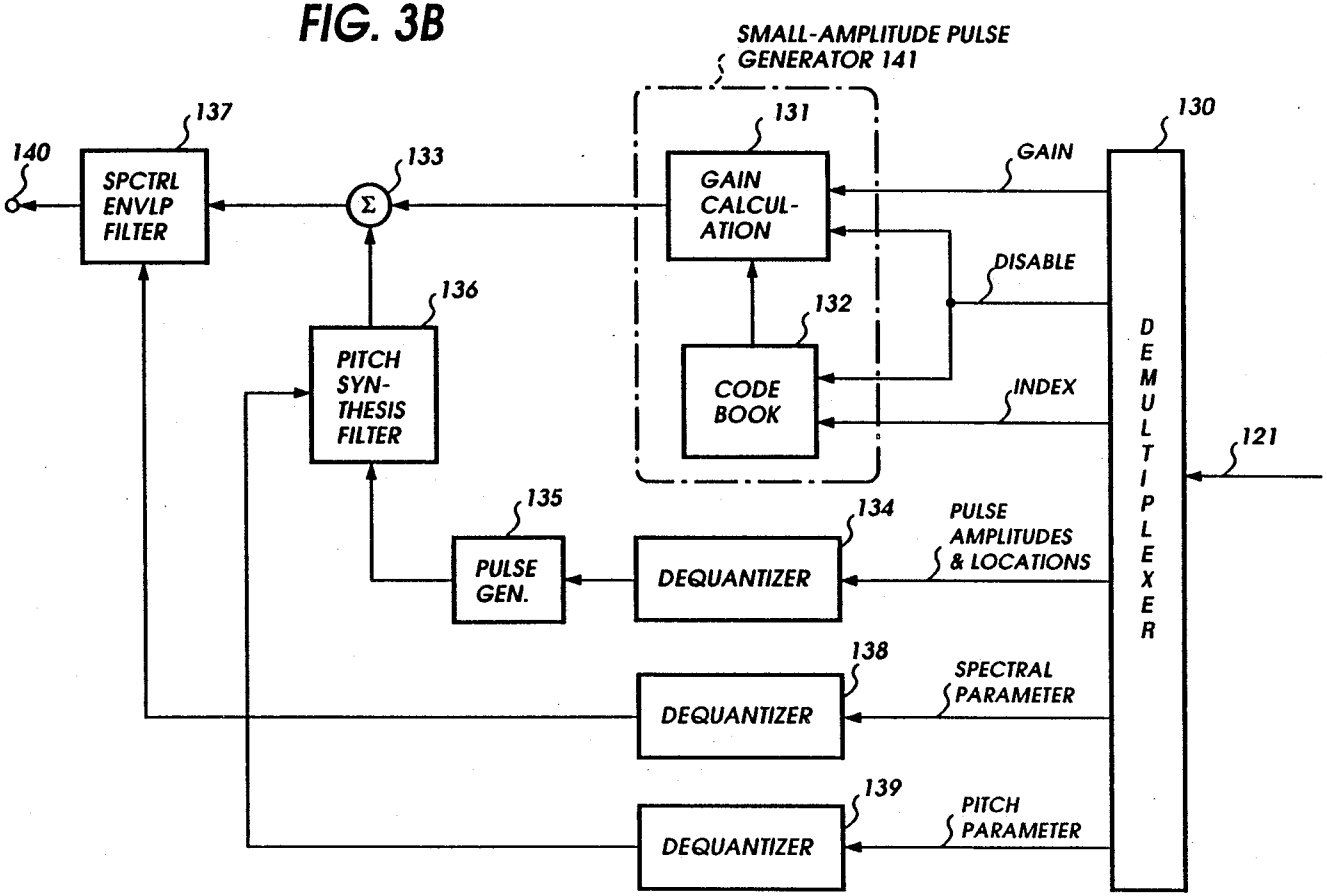

In FIG. 3B, the speech decoder of this modification extracts the disabling signal from the other multiplexed signals by the demultiplexer 130 and supplied to the gain calculation unit 131 and code book 132. Thus, the outputs of these circuits are nullified and no small-amplitude pulses are supplied to the adder 133 during the transmission of coded vowels.

Figure 4A:
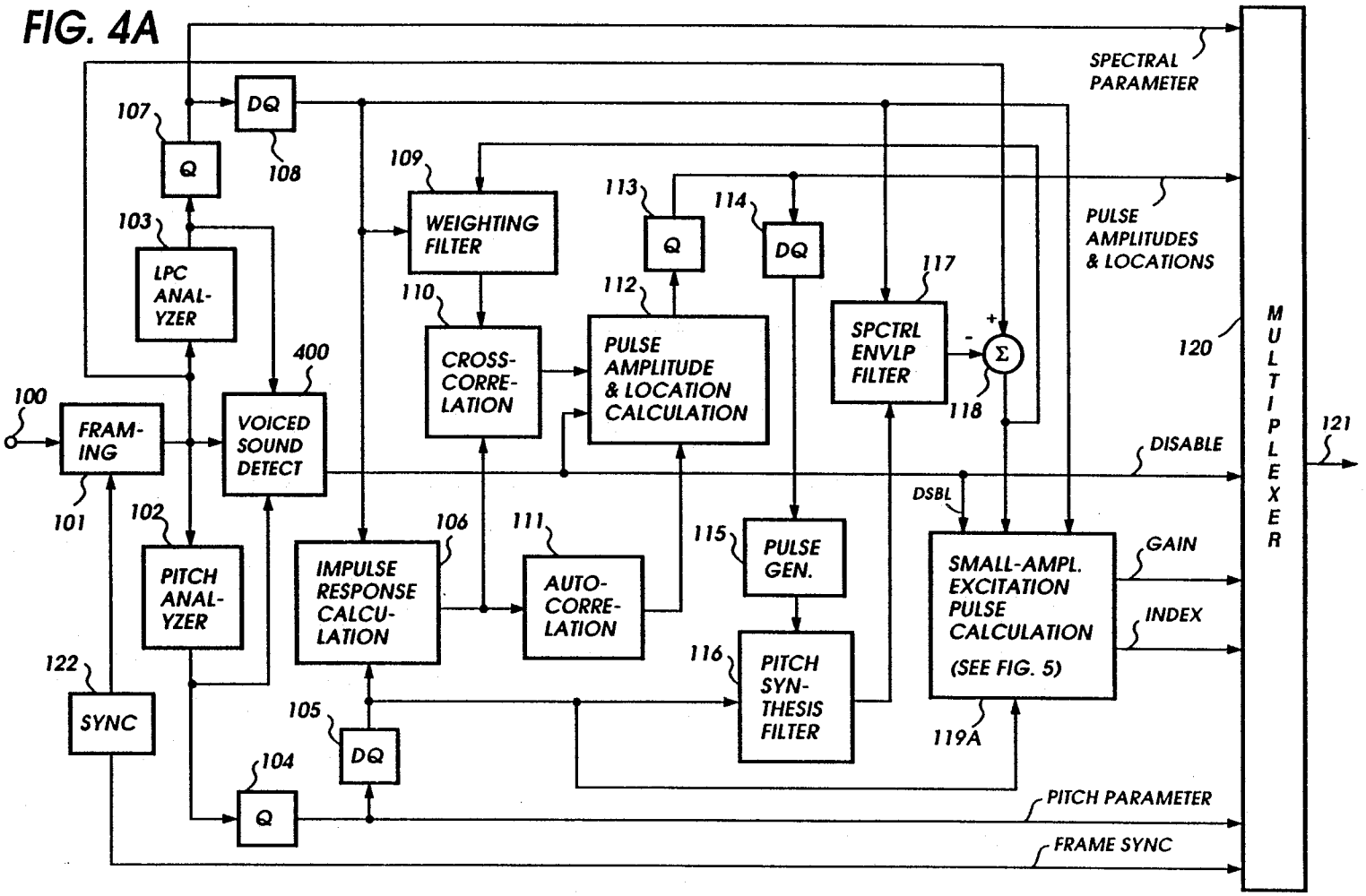
FIGS. 4A and 4B are block diagrams of the speech encoder and speech decoder, respectively, of a third embodiment of the present invention.
Figure 4B:
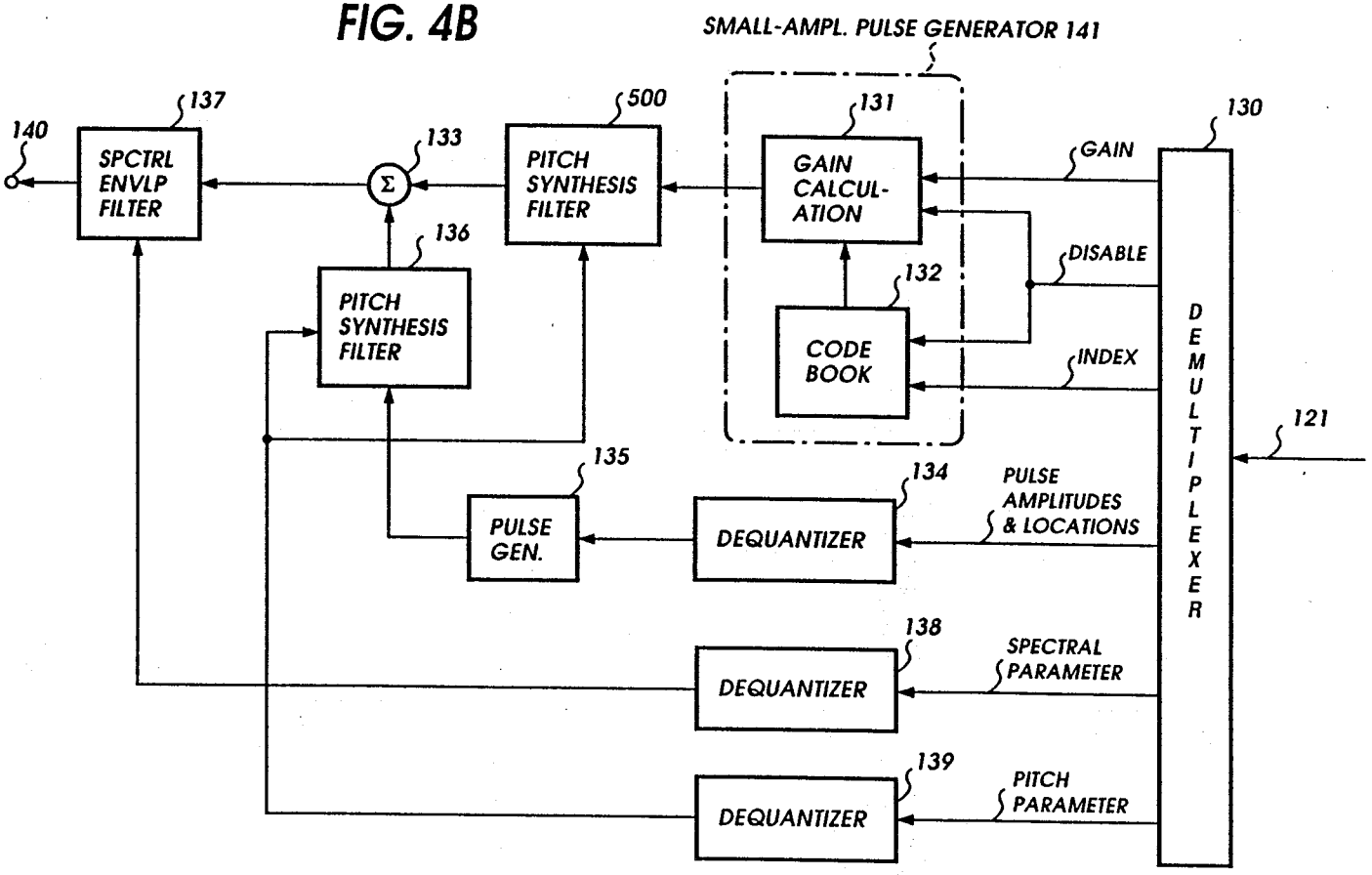
Figure 5:
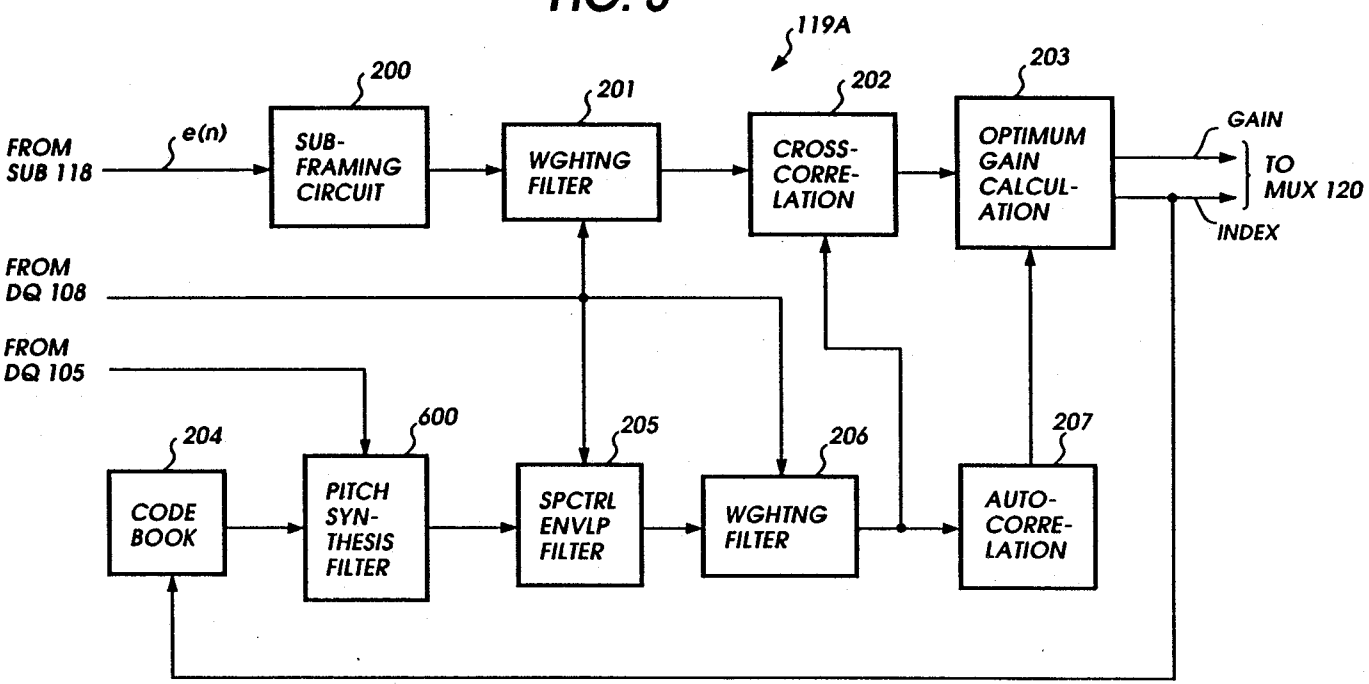
FIG. 5 is a block diagram of the small-amplitude calculation unit of FIG. 4A.

A second modification of the present invention is shown in FIGS. 4A, 4B and 5. In FIG. 4A, the speech encoder of this modification is similar to the embodiment of FIG. 3A with the exception that the pitch parameter signal from the output of dequantizer 105 is further supplied to small-amplitude excitation pulse calculation unit 119A to improve the degree of precision of vowels, or voiced sound components in addition to the precise definition of unvoiced, or consonants. As shown in FIG. 5, the small-amplitude calculation unit 119A includes a pitch synthesis filter 600 to modify the output of code book 204 with the pitch parameter signal from dequantizer 105 and supplies its output to the spectral envelope filter 205. In this way, the small-amplitude pulses can be approximated more faithfully to the original speech. The speech decoder of this modification includes a pitch synthesis filter 500 as shown in FIG. 4B. Pitch synthesis filter 500 is connected between the output of gain calculation unit 131 and the adder 133 to modify the amplitude-controlled, small-amplitude pulses in accordance with the transmitted pitch parameter signal.

Figure 6A:
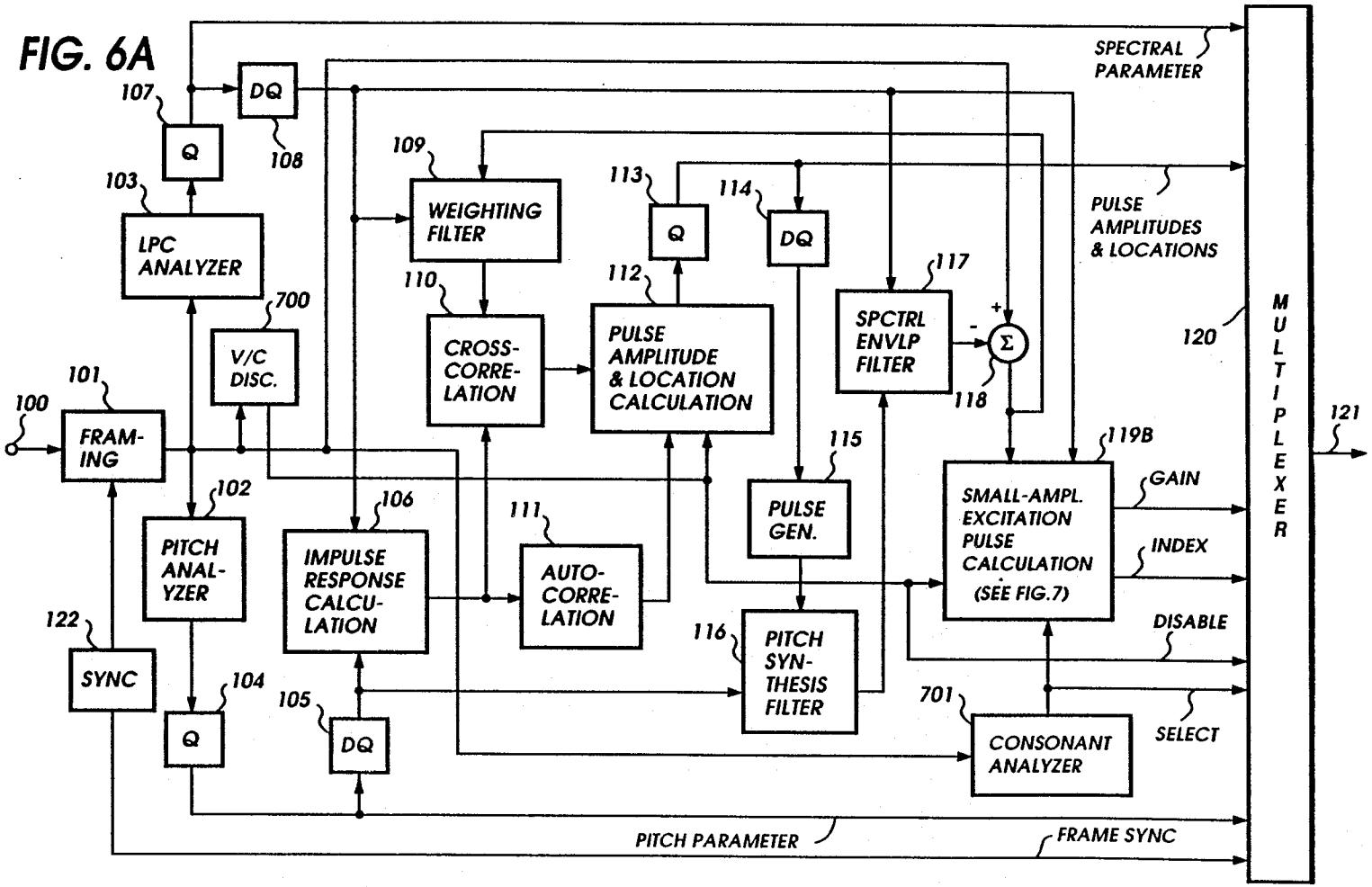
FIGS 6A and 6B are block diagrams of the speech encoder and speech decoder, respectively, of a fourth embodiment of the present invention.
Figure 6B:
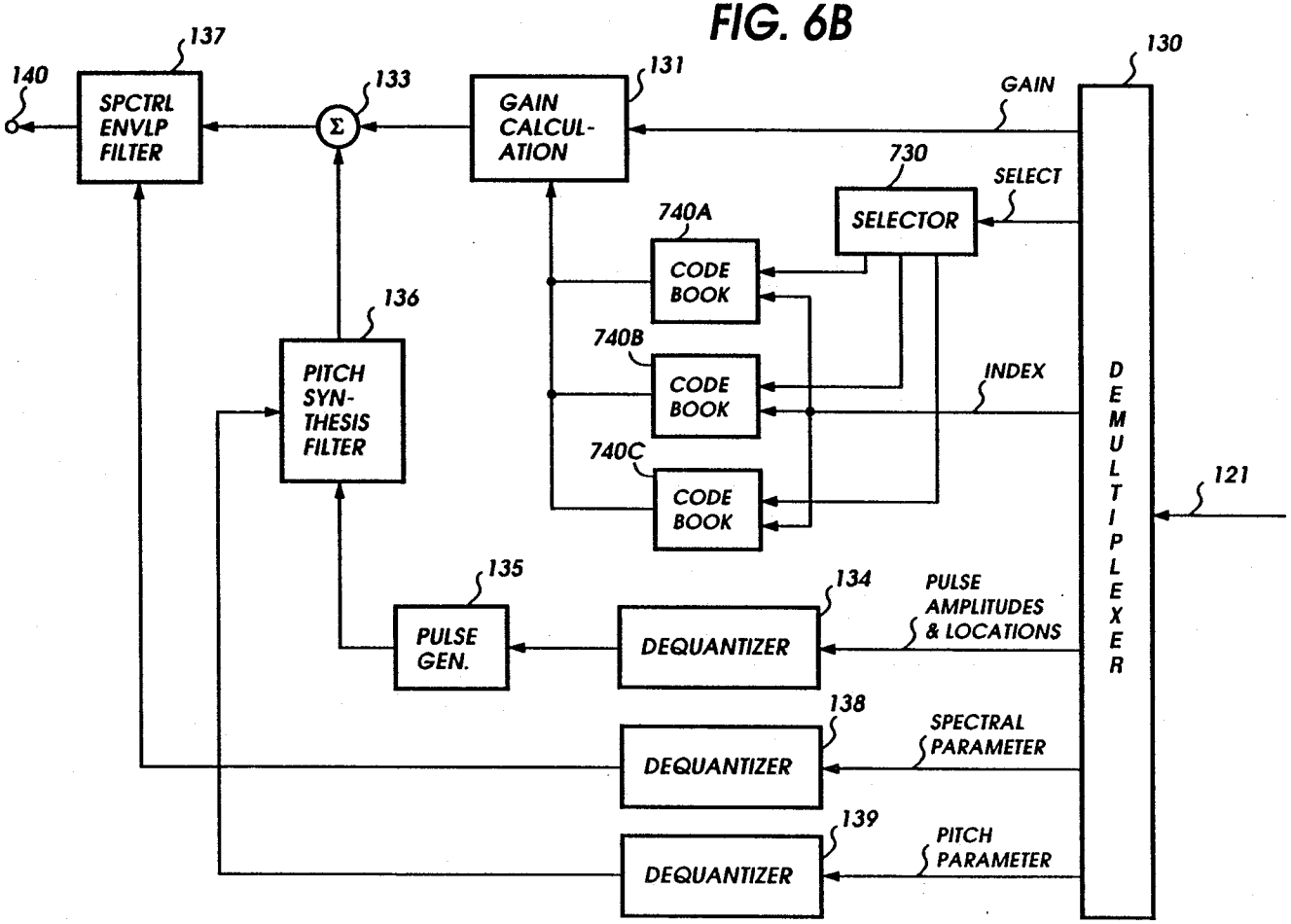
Figure 7:
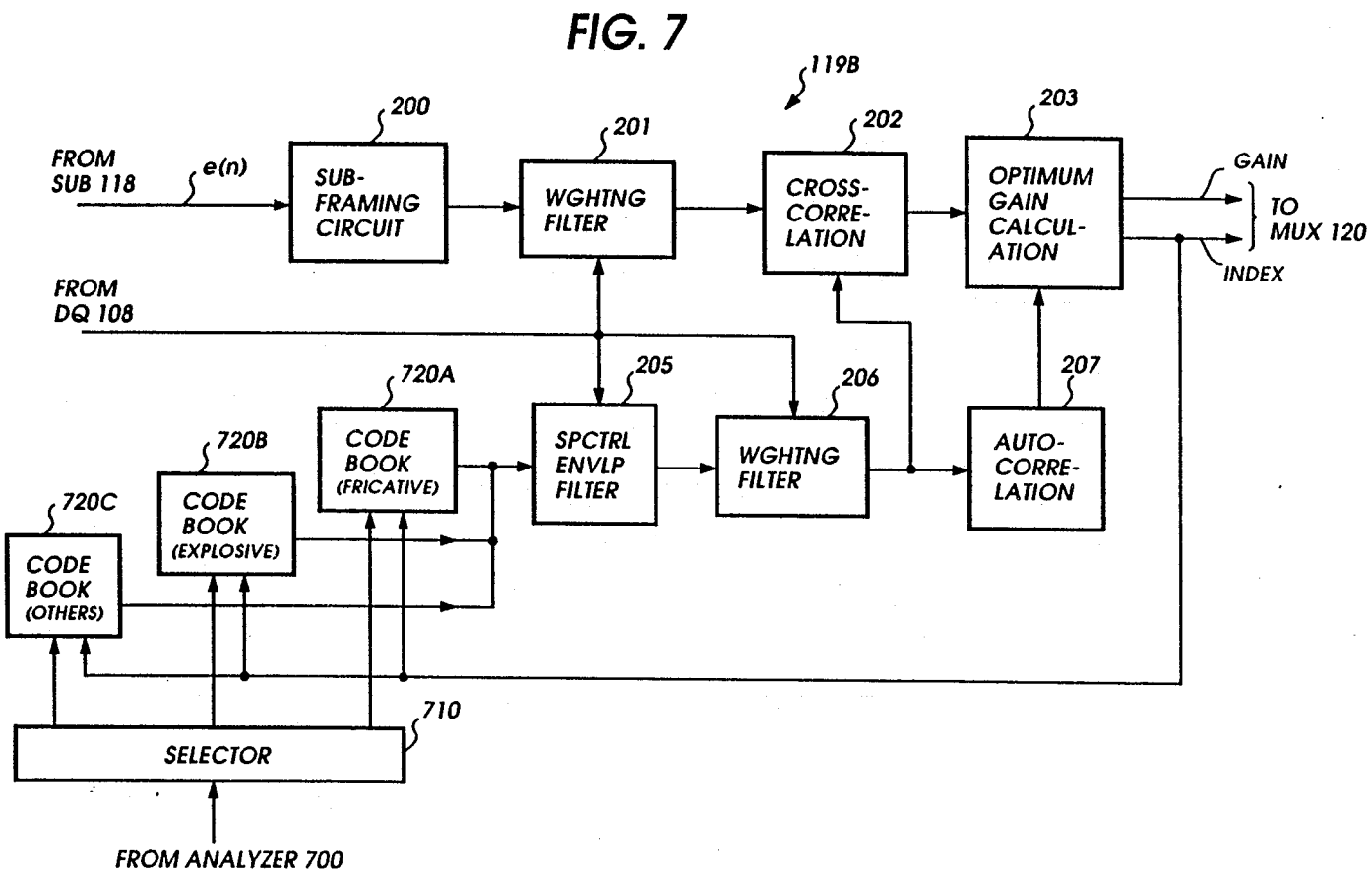
FIG. 7 is a block diagram of the small-amplitude calculation unit of FIG. 6A.

FIGS. 6A, 6B and 7 are illustrations of a third modified embodiment of the present invention. In FIG. 6A, the speech encoder includes a vowel/consonant discriminator 700 connected to the output of framing circuit 101 and a consonant analyzer 701. Discriminator 700 analyzes the speech samples and determines whether it is vowel or consonant. If a vowel is detected, discriminator 700 applies a vowel-detect (logic-1) signal to pulse amplitude and location calculation unit 112 to perform amplitude and location calculations on a greater number of excitation pulses. The vowel-detect signal is also applied to small-amplitude excitation pulse calculation unit 119B to nullify its gain and index signals and further applied to the multiplexer 120 and sent to the speech decoder as a disabling signal in a manner similar to the previous embodiments. When a consonant is detected, pulse amplitude and location calculation unit 112 responds to the absence of logic-1 signal from discriminator 700 and performs amplitude and location calculations on a smaller number of excitation pulses. Consonant analyzer 701 is connected to the output of framing circuit 101 to analyze the consonant of input signal to discriminate between "fricative", "explosive" and "other" consonant components using a known analyzing technique and generates a select code to small-amplitude excitation pulse calculation unit 119B and multiplexer 120 to be multiplexed with other signals.

As illustrated in FIG. 7, small-amplitude calculation unit 119B includes a selector 710 connected to the output of consonant analyzer 700 and a plurality of code books 720A, 720B and 720C which store small-amplitude code-book data corresponding respectively to the "fricative", "explosive" and "others" components. Selector 710 selects one of the code books in accordance with the select code from the analyzer 701. In this way, a replica of a more faithful reproduction of small-amplitude pulses can be realized. In FIG. 6B, the speech decoder separates the select code from the other signals by the demultiplexer 130 and additionally includes a selector 730 which receives the demultiplexed select code to select one of code books 740A, 740B and 740C which correspond respectively to the code books 720A, 720B and 720C. The index signal from demultiplexer 130 is applied to all the code books 740. One of the code books 740A, 740B 740C, which is selected, receives the index signal and generates a code-book signal for coupling to the gain calculation unit 131.

Figure 8:
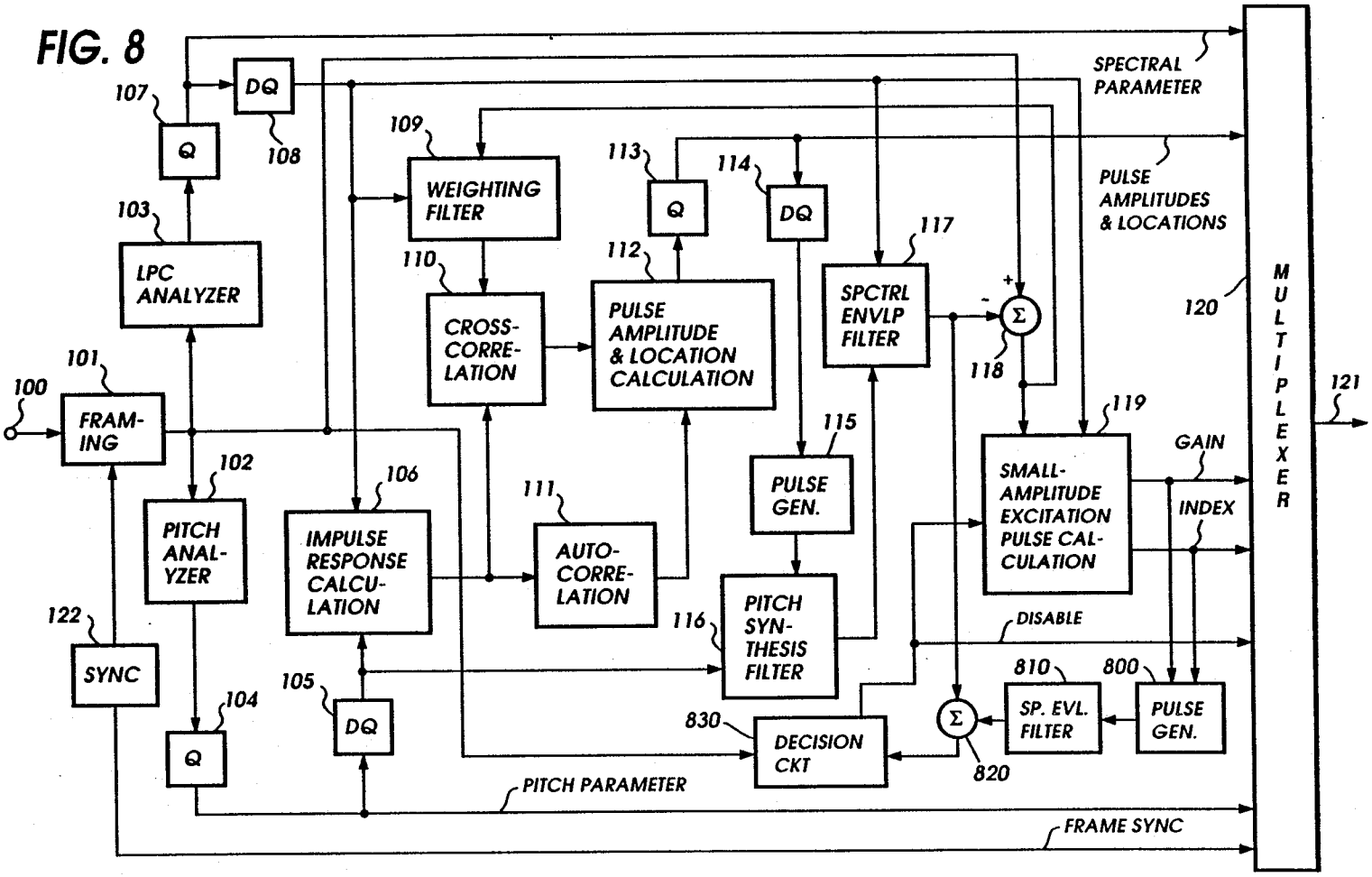
FIG. 8 is a block diagram of the speech encoder of a fifth embodiment of the present invention.

A further modification of the invention is shown in FIG. 8 in which the gain and index outputs of the small-amplitude calculation unit 119 are fed to a small-amplitude pulse generator 800 to reproduce the same small-amplitude pulses as those reconstructed in the speech decoder. The output of pulse generator 800 is supplied through a spectral envelope filter 810 to an adder 820 where it is summed with the output of spectral envelope filter 117. The output of adder 820 is supplied to one input of a decision circuit 830 for comparison with the output of framing circuit 101 and determines whether the recovered small-amplitude pulses are effective or ineffective. If a decision is made that they are ineffective, decision circuit 830 supplies a disabling signal to the small-amplitude excitation pulse calculation unit 119 as well as to multiplexer 120 to be multiplexed with other coded speech signals in order to disable the recovery of small-amplitude pulses at the speech decoder.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A speech encoder comprising:

means for analyzing a series of discrete speech samples and generating a first coded signal representative of a fine structure of the pitch of said speech samples and a second coded signal representative of a spectral characteristic of said speech samples;

means for determining amplitudes and locations of main excitation pulses from said first and second signals and generating a third coded signal representative of said determined pulse amplitudes and locations;

means for detecting a difference between said speech samples and said main excitation pulses;

a code book for storing auxiliary excitation pulses in locations addressable as a function of an index signal;

means for deriving said index signal from said difference and retrieving auxiliary excitation pulses from said code book with said index signal and deriving a gain signal and controlling the amplitude of the retrieved auxiliary excitation pulses with the gain signal so that the amplitude-controlled auxiliary excitation pulses approximate said difference; and means for transmitting said first, second and third coded signals, and said index and gain signals through a communication channel to a distant end.

2. A speech encoder as claimed in claim 1, wherein said amplitudes and locations determining means sequentially determines amplitudes and locations of excitation pulses so that said difference reduces to a minimum.

3. A speech encoder as claimed in claim 1, further comprising means for detecting a voiced sound component from said speech samples and disabling the transmission of said index signal and said gain signal upon detection of said voiced sound component.

4. A speech encoder as claimed in claim 3, wherein said index and gain signals deriving means comprises a pitch synthesis filter having a pitch characteristic variable in accordance with said first coded signal for modifying the auxiliary excitation pulses retrieved from said code book with said pitch characteristic.

5. A speech encoder as claimed in claim 4, wherein said index and gain signals deriving means further comprises a spectral envelope filter having a spectral envelope characteristic variable in accordance with said second coded signal for modifying the auxiliary excitation pulses retrieved from said code book with said spectral envelope characteristic.

6. A speech encoder as claimed in claim 1, further comprising:

means for detecting whether said speech samples contain a vowel component or a consonant component and disabling the transmission of said index signal and said gain signal upon the detection of said vowel component;

means responsive to the detection of said consonant component for analyzing consonant components of said speech samples and generating a select signal representative of different constituents of said consonant components;

a second code book for storing auxiliary excitation pulses of different characteristic from those stored in the first-mentioned code book; and means for selecting one of said first and second code books in accordance with said select signal, wherein said transmitting means transmits said select signal through said communication channel.

7. A speech encoder as claimed in claim 1, further comprising:

means for recovering said auxiliary excitation pulses from said index signal and said gain signal; and means for determining when the recovered auxiliary excitation pulses are ineffective and disabling the transmission of said index signal and said gain signal.

8. A speech encoder as claimed in claim 1, wherein said index and gain signals deriving means comprises:

a spectral envelope filter having a spectral envelope characteristic variable in accordance with said second coded signal for modifying the auxiliary excitation pulses retrieved from said code book with said spectral envelope characteristic;

a first weighting filter having a perceptual weighting function variable with said second coded signal for modifying said difference with said perceptual weighting function;

a second weighting filter having a perceptual weighting function variable with said second coded signal for modifying said auxiliary excitation pulses retrieved from said code book with said perceptual weighting function;

wherein said gain signal is given by "g" which satisfies the following relation:

$$g = \frac{\Sigma e_w(n)\widetilde{e}_w(n)}{\Sigma \widetilde{e}_w(n)\widetilde{e}_w(n)}$$

where, $\widetilde{e}_w(n) = \widetilde{e}(n) * w(n) = n(n) * h(n) * w(n)$, $e_w(n) = e(n) * w(n)$, $e(n)$ = said difference, $\widetilde{e}(n)$ = the output signal of said spectral envelope filter, $w(n)$ = the impulse response characteristic of each of said first and second weighting filters, $h(n)$ = the impulse response of said spectral envelope filter, and the symbol * representing convolutional integration, wherein said index and gain signals deriving means includes means for computing the relation given by "g" and selecting a result of the computations that minimizes the following relation:

$$\sum_n [\{e(n) - g \cdot \widetilde{e}(n)\} * w(n)]^2$$

9. A speech encoder as claimed in claim 1, wherein said transmitting means comprises a multiplexer for multiplexing said first, second and third coded signals and said index and gain signals.

10. A speech decoder comprising:

means for receiving a signal through a communication channel, said signal containing a first coded signal representative of a fine structure of the pitch of discrete speech samples, a second coded signal representative of a spectral characteristic of said speech samples, a third coded signal representative of amplitudes and locations of main excitation pulses, an index signal and a gain signal;

a code book for storing auxiliary excitation pulses and retrieving the stored auxiliary excitation pulses with said index signal;

gain determination means responsive to said gain signal for modifying the amplitudes of said auxiliary excitation pulses retrieved from said code book;

a pulse generator for reproducing said main excitation pulses in accordance with said third coded signal;

a pitch synthesis filter having a pitch characteristic variable with said first coded signal for modifying said reproduced main excitation pulses with said pitch characteristic;

means for combining the outputs of said pitch synthesis filter and said gain determination means; and a spectral envelope filter having a spectral envelope characteristic variable with said second coded signal for modifying the combined outputs with said spectral envelope characteristic.

11. A speech decoder as claimed in claim 10, wherein said received signal further contains a disabling signal representative of the presence of a voiced sound component in said speech samples, and wherein said gain determination means and said code book are disabled in response to said disabling signal.

12. A speech decoder as claimed in claim 10, further comprising a second pitch synthesis filter having a pitch characteristic variable with said first coded signal for modifying the output of said gain determination means and applying the modified output to said combining means.

13. A speech decoder as claimed in claim 10, wherein said received signal further contains a select signal representative of different constituents of consonants of said speech samples, further comprising a second code book for storing auxiliary excitation pulses of different characteristic from those stored in the first-mentioned code book and means for selecting one of said first and second code books in response to said select signal.

14. A speech decoder as claimed in claim 10, wherein said received signal further contains a disabling signal which indicates that said gain and index signals are ineffective, and wherein said gain determination means and said code book are disabled in response to said disabling signal.

15. A coded speech communication system comprising:

means for analyzing a series of discrete speech samples and generating a first signal representative of a fine structure of the pitch of said speech samples and a second signal representative of a spectral characteristic of said speech samples;

means for deriving amplitudes and locations of main excitation pulses from said first and second signals and generating a third signal representative of said determined pulse amplitudes and locations;

means for generating a fourth signal representative of auxiliary excitation pulses;

means for transmitting said first, second, third and fourth signals from a transmit end of a communication channel to a receive end of the channel;

means for receiving said first, second, third and fourth signals at said receive end;

means for deriving a replica of said main excitation pulses from said received first and third signals;

means including a code book for deriving a replica of said auxiliary excitation pulses from said code book in response to said received fourth signal; and means for modifying said replicas with said second signal to recover a replica of said speech samples.

16. A coded speech communication system comprising:

a speech encoder comprising:

means for analyzing a series of discrete speech samples and generating a first coded signal representative of a fine structure of the pitch of said speech samples and a second coded signal representative of a spectral characteristic of said speech samples;

means for determining amplitudes and locations of main excitation pulses from said first and second coded signals as well as from a feedback signal, generating a third coded signal representative of said determined pulse amplitudes and locations, detecting a difference between said speech samples and said main excitation pulses as said feedback signal and controlling the process of the determination of said amplitudes and locations so that said difference is minimized;

a first code book for storing auxiliary excitation pulses in locations addressable as a function of an index signal;

means for deriving said index signal from said difference and retrieving auxiliary excitation pulses from said first code book with said index signal and deriving a gain signal and controlling the amplitude of the retrieved auxiliary excitation pulses with the gain signal so that the amplitude-controlled auxiliary excitation pulses approximate said difference; and means for transmitting said first, second and third coded signals, said index signal and said gain signal through a communication channel, and a speech decoder comprising:

means for receiving said first, second and third coded signals, said index signal and said gain signal through said communication channel;

a second code book for storing auxiliary excitation pulses identical to those stored in said first code book and retrieving the stored auxiliary excitation pulses with said received index signal;

gain determination means for modifying the amplitudes of said auxiliary excitation pulses retrieved from said second code book with said received gain signal;

a pulse generator for reproducing said main excitation pulses in accordance with said received third coded signal;

a pitch synthesis filter having a pitch characteristic variable with said received first coded signal for modifying said reproduced main excitation pulses with said pitch characteristic;

means for combining the outputs of said pitch synthesis filter and said gain determination means; and a spectral envelope filter having a spectral envelope characteristic variable with said received second coded signal for modifying the combined outputs with said spectral envelope characteristic.

17. A coded speech communication system as claimed in claim 16, said speech encoder further comprises means for detecting a voiced sound component from said speech samples, disabling the transmission of said index signal and said gain signal upon detection of said voiced sound component and transmitting a disabling signal representative of the detection of said voiced sound component, and wherein said receiving means receives said disabling signal, and said second code book and said gain determination means are responsive to the received disabling signal to nullify their outputs.

18. A coded speech communication system as claimed in claim 17, wherein said index and gain signals deriving means comprises a first pitch synthesis filter having a pitch characteristic variable in accordance with said first coded signal for modifying the auxiliary excitation pulses retrieved from said first code book with said pitch characteristic, and wherein said speech decoder comprises a second pitch synthesis filter having a pitch characteristic variable with said received first coded signal for modifying the output of said gain determination means and applying the modified output to said combining means.

19. A coded speech communication system as claimed in claim 18, wherein said index and gain signals deriving means further comprises a spectral envelope filter having a spectral envelope characteristic variable in accordance with said second coded signal for modifying the auxiliary excitation pulses retrieved from said first code book with said spectral envelope characteristic.

20. A coded speech communication system as claimed in claim 16, wherein said speech encoder further comprises:

means for detecting whether said speech samples contain a vowel component or a consonant component and disabling the transmission of said index signal and said gain signal upon the detection of said vowel component;

means responsive to the detection of said consonant component for analyzing consonant components of said speech samples and generating a select signal representative of different constituents of said consonant components;

a third code book for storing auxiliary excitation pulses of different characteristic from those stored in said first code book; and means for selecting one of said first and third code books in accordance with said select signal, wherein said transmitting means tranmits said select signal through said communication channel, wherein said receiving means receives said select signal, said speech decoder further comprising a fourth code book for storing auxiliary excitation pulses of different characteristic from those stored in said second code book and means for selecting one of said second and fourth code books in response to said received select signal.

21. A coded speech communication system as claimed in claim 16, wherein said speech encoder further comprises:

means for recovering said auxiliary excitation pulses from said index signal and said gain signal; and means for determining when the recovered auxiliary excitation pulses are ineffective and disabling the transmission of said index signal and said gain signal, wherein said receive means receives said disabling signal, said gain determination means and said second code book being responsive to the received disabling signal to nullify their outputs.

22. A coded speech communication system as claimed in claim 16, wherein said index and gain signals deriving means comprises:

a spectral envelope filter having a spectral envelope characteristic variable in accordance with said second coded signal for modifying the auxiliary excitation pulses retrieved from said first code book with said spectral envelope characteristic;

a first weighting filter having a perceptual weighting function variable with said second coded signal for modifying said difference with said perceptual weighting function;

a second weighting filter having a perceptual weighting function variable with said second coded signal for modifying said auxiliary excitation pulses retrieved from said first code book with said perceptual weighting function;

wherein said gain signal is given by "g" which satisfies the following relation:

$$g = \frac{\Sigma e_w(n)\overline{e}_w(n)}{\Sigma e_w(n)\overline{e}_w(n)}$$

where, $e_w(n) = e(n)*w(n) = n(n)*h(n)*w(n)$, $e_w(n) = e(n)*w(n)$, $e(n)$ = said difference, $e(n)$ = the output signal of said spectral envelope filter, $w(n)$ = the impulse response characteristic of each of said first and second weighting filters, $h(n)$ = the impulse response of said spectral envelope filter, and the symbol* representing convolutional integration, wherein said index and gain signals deriving means includes means for computing the relation given by "g" and selecting a result of the computations that minimizes the following relation:

$$\sum_n [\{e(n) - g \cdot \overline{e}(n)\} * w(n)]^2$$

23. A coded speech communication system as claimed in claim 16, wherein said transmitting means comprises a multiplexer for multiplexing said first, second and third coded signals and said index and gain signals and said receiving means comprises a demultiplexer for demultiplexing said received signals.

* * * * *

UNITED STATES PATENT AND TRADEMARK OFFICE

CERTIFICATE OF CORRECTION

PATENT NO. : 4,975,958

DATED : December 4, 1990

INVENTOR(S) : Hanada, et al

It is certified that error appears in the above-identified patent and that said Letters Patent is hereby corrected as shown below:

| | | |
|---|---|---|
| Col. 2, | line 48 | delete "respecxtively" and insert -- respectively -- |
| Col. 4, | line 23 | delete "syntesized" and insert -- synthesized -- |
| Col. 4, | line 28 | delete "Lain - Open" and insert -- Laid - Open -- |
| Col. 16, | line 3 | delete "e" and Insert -- ẽ -- |

UNITED STATES PATENT AND TRADEMARK OFFICE

CERTIFICATE OF CORRECTION

PATENT NO. : 4,975,958

DATED : December 4, 1990

INVENTOR(S) : Hanada, et al

It is certified that error appears in the above-identified patent and that said Letters Patent is hereby corrected as shown below:

Col. 16, line 6 delete "$e_w(n) = e(n)$" and insert -- $\tilde{e}_w(n) = \tilde{e}(n)$ --

Col. 16, line 9 delete "$e(n)$" and insert -- $\tilde{e}(n)$ --

Signed and Sealed this

Twenty-second Day of September, 1992

*Attest:*

DOUGLAS B. COMER

*Attesting Officer* *Acting Commissioner of Patents and Trademarks*